United States Patent [19]

Bachmann

[11] 4,347,882

[45] Sep. 7, 1982

[54] CUTTERHEAD FOR A POWER PLANER

[75] Inventor: Rainer Bachmann, Hohenstein, Fed. Rep. of Germany

[73] Assignee: Black & Decker Inc., Newark, Del.

[21] Appl. No.: 194,833

[22] Filed: Oct. 7, 1980

[51] Int. Cl.[3] ..... B27C 1/10; B27G 13/04

[52] U.S. Cl. ..... 144/225; 145/4

[58] Field of Search ..... 145/4; 144/230, 225

[56] References Cited

U.S. PATENT DOCUMENTS

| | | | |
|---|---|---|---|
| 76,556 | 4/1868 | Tosterin | 144/225 |
| 275,890 | 4/1883 | Cross | 144/225 |
| 353,509 | 11/1886 | Shimer | 144/225 |
| 811,769 | 2/1906 | Forbes | 144/225 |
| 1,400,245 | 12/1921 | Smith | 144/225 |

FOREIGN PATENT DOCUMENTS

| | | | |
|---|---|---|---|
| 637215 | 10/1936 | Fed. Rep. of Germany | 144/225 |

*Primary Examiner*—Donald R. Schran

*Attorney, Agent, or Firm*—Walter Ottesen; Edward D. Murphy; Harold Weinstein

[57] ABSTRACT

The invention is directed to a rotary cutterhead for a portable power planer tool, as well as a method of making the cutterhead. The cutterhead includes an elongated core and a pressure plate mounted on the core and which cooperates therewith to define a slot-like opening for receiving a cutting blade and locating the cutting edge thereof relative to the cutting circle of the cutterhead. The pressure plate is positioned and fixed in a permanent location relative to the core so that the cutting edge of any standard cutting blade of predetermined dimensions will extend from the opening beyond the cutting circle of the cutterhead a preferred optimum distance for performing a planing operation. The cutterhead includes a cover portion having a clamping edge which biases the pressure plate toward the core when the cover portion is tightened so that the two cooperate to clampingly retain the cutting blade within the opening. The pressure plate includes a projection which extends into the opening and prevents radial ejection of the cutting blade therefrom if an operator neglects to tighten the cover portion.

12 Claims, 8 Drawing Figures

CUTTERHEAD FOR A POWER PLANER

BACKGROUND AND SUMMARY OF THE INVENTION

The present invention relates to portable power planers and in particular to an improved cutterhead assembly for a power planer.

In general, portable power planers include a motor driven rotary cutterhead having one or more blade retaining or pressure plate assemblies which are operative to retain cutting blades for rotation with the cutterhead to engage and perform a cutting operation upon the surface of a workpiece. Such cutting blades are made in standard sizes of predetermined dimensions and are adapted to be assembled with such pressure plate assemblies. Prior known cutterhead assemblies have required means for adjusting the elevation of either the cutting blade or the pressure plate assembly relative to the cutterhead so that the cutting edge of the blade projects beyond the cutting circle of the cutterhead the distance required for performing a proper cutting operation. Such prior cutterhead assemblies have also required clamping means for clamping either the cutting blade or the pressure plate to the body of the cutterhead to prevent radial ejection of the blade or blade-pressure plate assembly during use of these power planer devices.

The need for an operator to make adjustments in the elevation of the cutting blades for efficient operation of such prior devices results in an inconvenience for the operator during installation, reversal or replacement of cutting blades. Moreover, the elevation adjusting means and clamping means for such prior power planer devices have generally been provided in the form of bolts or screws which, of necessity, must be turned and adjusted by the operator to effect efficient and safe operation of such devices. Due to space limitations, the size and placement of these bolts or screws often makes such adjustments time consuming and tedious. Furthermore, an operator can occasionally forget to make these adjustments, which can result in these devices operating inefficiently or improperly. Additionally, such prior devices are of a generally complicated configuration and require the component parts of the cutterhead assembly to be manufactured to fairly close tolerances.

It is therefore an object of the present invention to provide a cutterhead assembly which can receive cutting blades of standard and predetermined dimensions without requiring an operator to make adjustments on the cutterhead when replacing or reversing the cutting blade in order to position the cutting blade in elevation so that the cutting edge thereof projects beyond the cutting circle of the cutterhead the desired proper distance.

It is a further object of the present invention to provide such a cutterhead assembly wherein the cutting blade is retained against radial ejection from the assembly during operation of the power planer even absent the exertion of a clamping force to hold the blade in fixed relation to the cutterhead.

It is an additional object of the present invention to provide such a cutterhead assembly which is of a simplified and less costly configuration, and which can accommodate tolerance variations which occur during the manufacture of the respective parts to reduce the manufacturing costs thereof.

Also, it is an object of the present invention to provide such a cutterhead assembly which enables the assembly to be easily serviced, and cutting blades to be simply and efficiently installed, reversed and replaced.

The cutterhead assembly according to the present invention includes an elongated core and a pressure plate which is permanently assembled with the core. The pressure plate is assembled with the core by a pair of bolts which extend through apertures in the pressure plate and into threaded bores in the core. When assembled with the core, the pressure plate includes a cantilevered portion which cooperates with a face of the core to define a longitudinally extending blade receiving slot for receiving blades of a standard configuration. The apertures in the pressure plate are formed to define laterally elongated openings which allow the pressure plate to be moved relative to the core prior to assembly therewith for properly defining the blade receiving slot. This feature provides a cutterhead assembly which can accommodate tolerance variations occurring during the manufacture of the core and the pressure plate. To properly align the pressure plate relative to the core, these pieces are placed in a jig or fixing machine with a standard cutting blade and the pressure plate is positioned on the core to place the cutting blade in its preferred position with respect to the cutting circle of the cutterhead assembly. The pressure plate can thereafter be fixed in its chosen location relative to the core by tightening the previous described bolts.

Cutting blades for the assembly can be installed by longitudinally inserting them into the blade receiving slot from one end of the assembly. The assembly includes a cover portion which is assembled with the core and pressure plate by a series of clamping bolts extending through the cover portion, a second set of elongated apertures in the pressure plate, and into threaded bores in the core. When the clamping bolts are tightened, the cover portion will clampingly load the cantilevered portion of the pressure plate, enabling it to cooperate with the core to clampingly retain the cutting blade in the blade receiving slot. The cantilevered portion of the pressure plate includes a longitudinally extending projection which extends into the blade receiving slot and is adapted to engage a generally complementary-shaped recess extending longitudinally along one face of the cutting blade. This projection is preferably of sufficient height to prevent radial ejection of the cutting blade in the event an operator neglects to tighten the clamping bolts on the cover portion.

Additional objects and advantages of the present invention will become apparent from a reading of the detailed description of the preferred embodiment which makes reference to the following set of drawings in which:

DETAILED DESCRIPTION OF THE PREFERRED EMBODIMENTS

Figure 1:
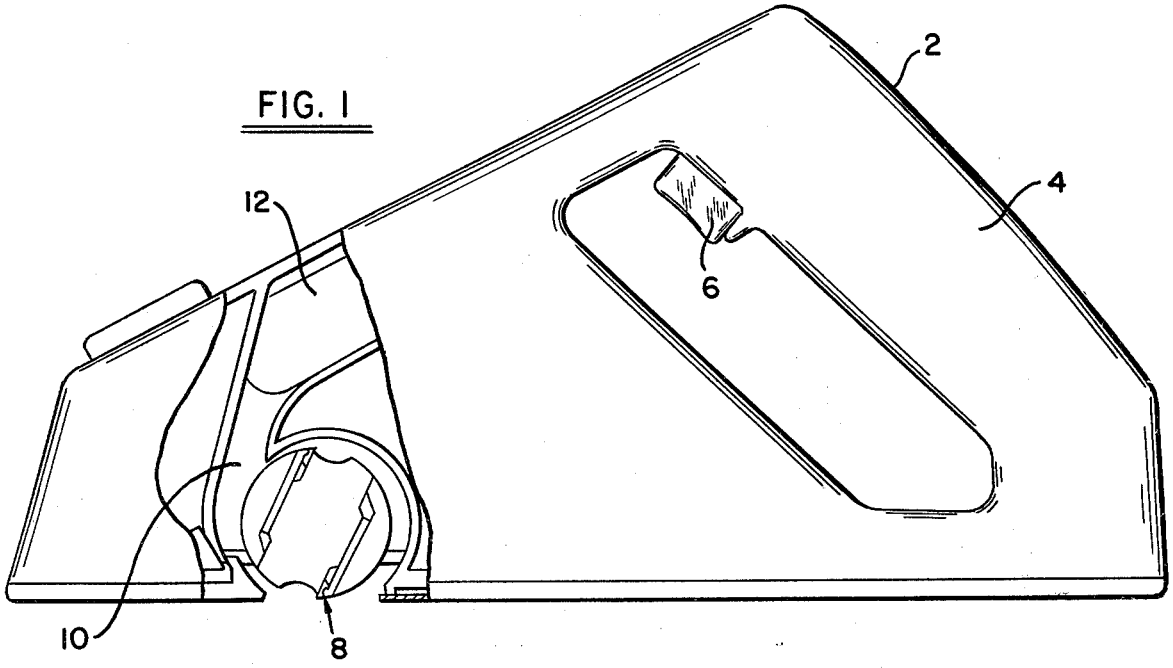
FIG. 1 is an elevational view of a power planer, with a portion broken away to illustrate a cutterhead assembly in accordance with the present invention.
Figure 2:
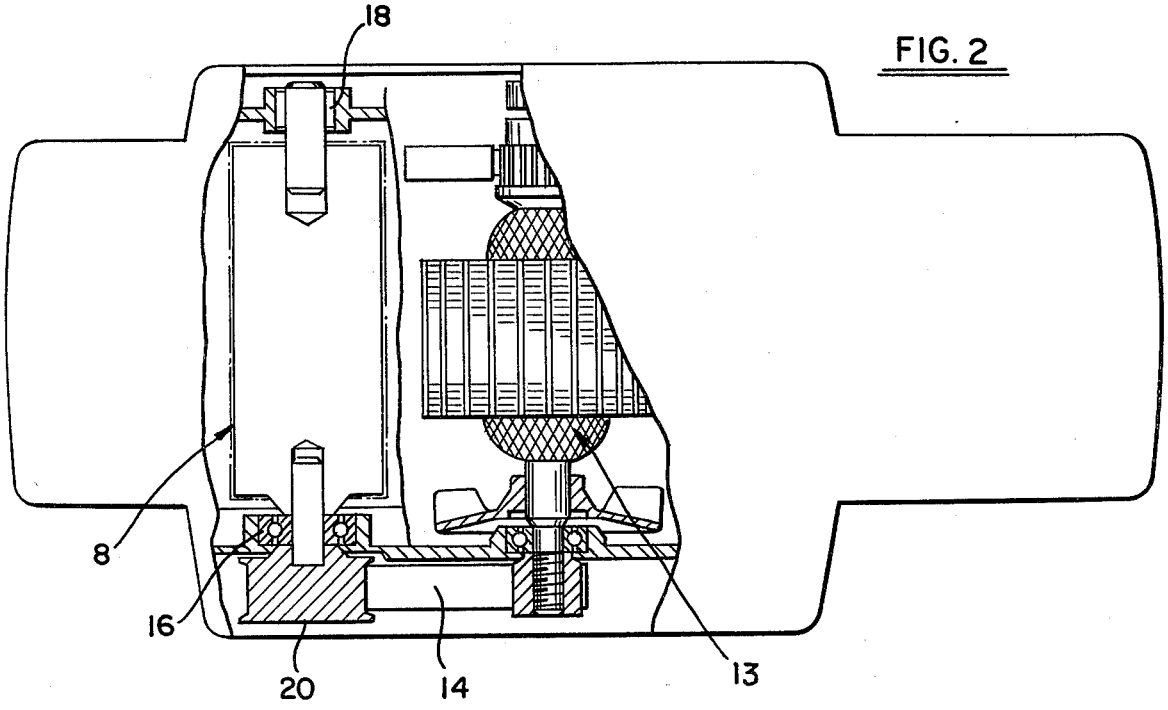
FIG. 2 is a plan view of the power planer of FIG. 1, with a section broken out to show the cutterhead assembly mounted in its operative position.
Figure 3:
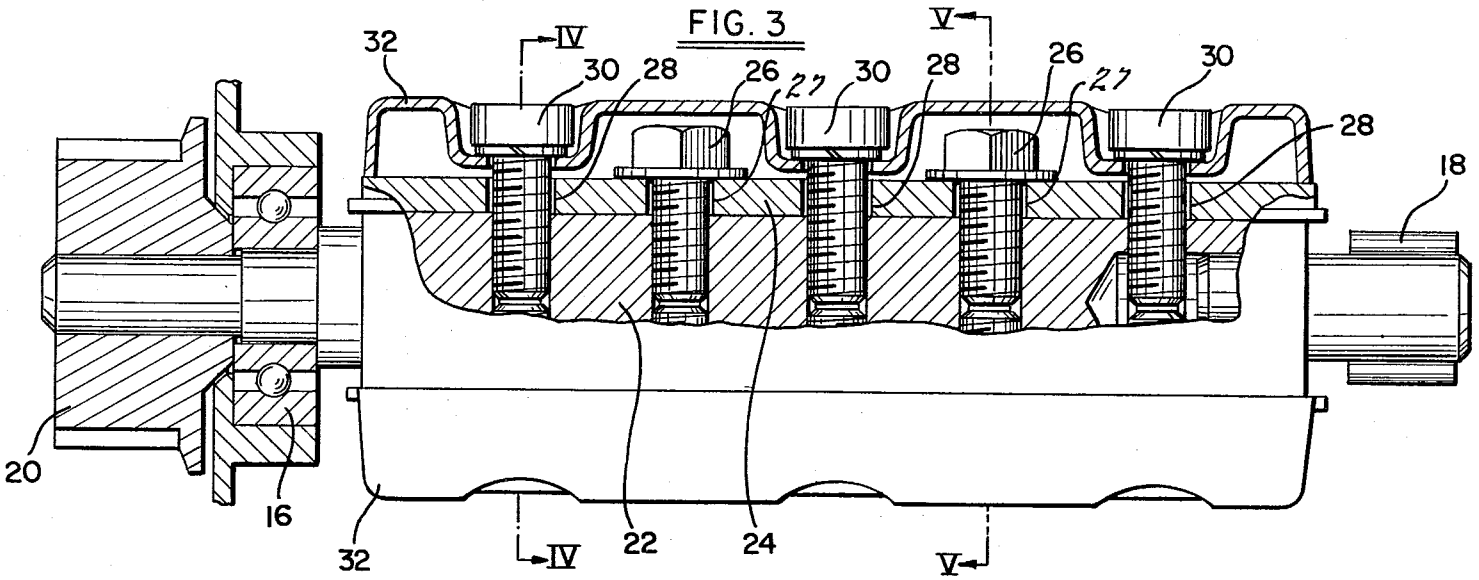
FIG. 3 is an elevational view, partially in section, illustrating the cutterhead assembly of FIG. 1.

Referring now to the drawings, a power planer 2 incorporating a cutterhead assembly according to the teachings of the present invention is shown generally in FIGS. 1 and 2. The power planer 2 is provided with a closed handle 4 and a trigger switch 6 at its rearward end. The forward portion of the power planer 2 includes a cutterhead assembly 8 which is rotatably held in the housing of power planer 2 by means of bearings 16 and 18. As shown in FIG. 2, the cutterhead assembly 8 is fixed for rotation with a pulley 20 disposed outwardly adjacent bearing 16. A guide passage 10 communicates between cutterhead assembly 8 and a vent 12 in one sidewall of the housing for directing workpiece chips from cutterhead assembly 8 to the vent 12 for evacuation therefrom. The central portion of the power planer 2 includes a motor 13 which is rotatably mounted within the housing of the power planer 2. The motor 13 is operative to drive cutterhead assembly 8 and is drivingly coupled therewith in a conventional manner by way of a flexible transmitter or belt 14 extending between the output shaft of the motor 13 and pulley 20.

As shown in FIGS. 3 through 8, the cutterhead assembly 8 includes a central core 22 and a pressure plate 24 which is operative to be fitted to core 22 and permanently assembled therewith by way of two fixing bolts 26 which are inserted through a pair of apertures 27 in pressure plate 24 and threaded into complementary threaded bores in core 22. When assembled with core 22, pressure plate 24 defines a cantilevered portion which cooperates with core 22 to define a longitudinally extending blade receiving recess or slot 42. The cantilevered portion of pressure plate 24 includes a longitudinally extending projection 48 formed thereon so as to extend into slot 42. The configuration of slot 42 and projection 48 allow the cutterhead assembly 8 to receive and retain a standard cutting blade 38 of predetermined dimensions in a manner described more fully hereinafter.

The pressure plate 24 also includes three apertures 28 which are operative to accommodate three clamping bolts 30 for assembling a cover portion 32 onto the subassembly of core 22 and pressure plate 24. As shown most readily in FIGS. 3, 4 and 8, cover portion 32 is formed as an elongated generally cylindrical shell which includes three longitudinally spaced recesses 34 for accommodating the heads of clamping bolts 30 to effect a generally flush assembly. The cover portion 32 defines first and second longitudinally extending edges 35 and 36 which are operative to engage core 22 and pressure plate 24, respectively, upon assembly of cover portion 32 therewith. Cover portion 32 is of a length substantially equal to the length of core 22 and pressure plate 24 and is operative to render fixing bolts 26 inaccessible to an operator once the cover portion 32 has been assembled over the pressure plate 24.

Figure 5:
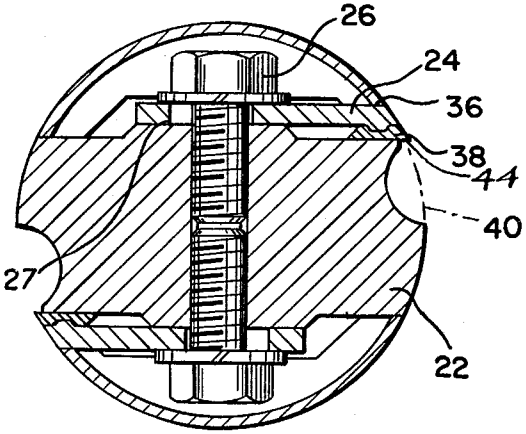
FIG. 5 is a sectional view taken generally along the Line V—V of FIG. 3.
Figure 4:
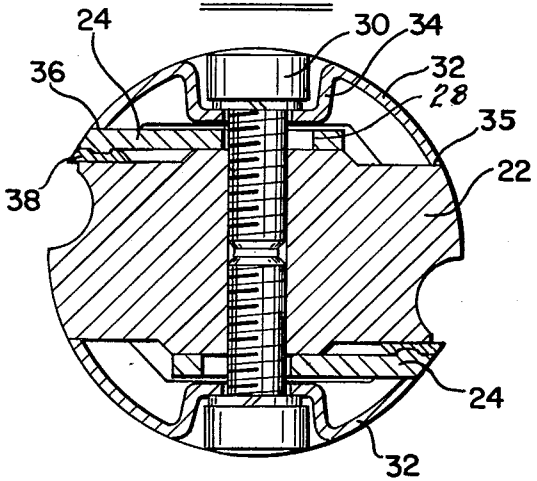
FIG. 4 is a sectional view taken generally along the Line IV—IV of FIG. 3.
Figure 8:
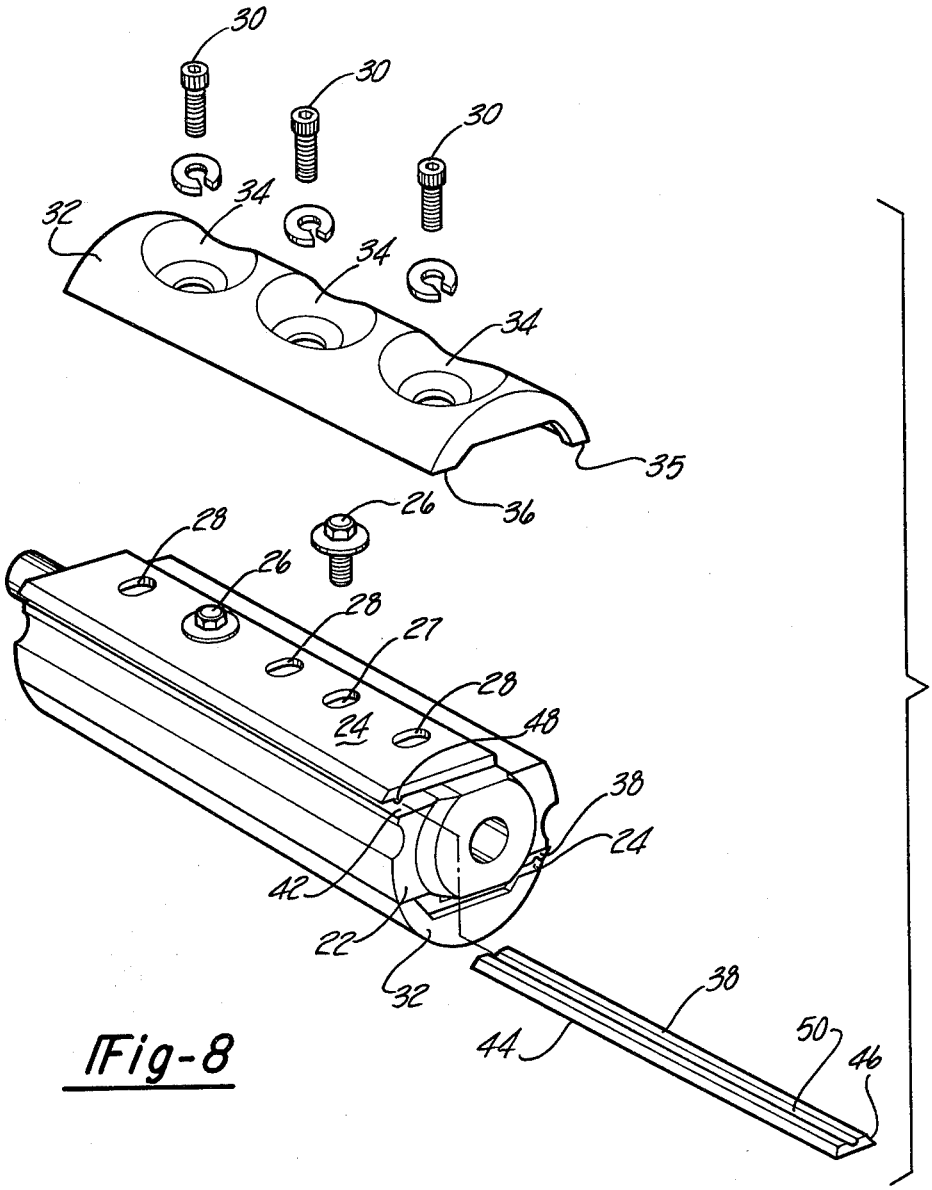
FIG. 8 is a partially exploded perspective view of the cutterhead assembly.

With respect to the assembly of pressure plate 24 to core 22, attention is directed to FIGS. 4, 5 and 8 where apertures 27 and 28 in pressure plate 24 are shown as defining laterally elongated openings. This feature provides cutterhead assembly 8 with the ability to accommodate tolerance variations occurring during the manufacture of core 22 and pressure plate 24. More specifically, the elongated shape of these apertures allows the pressure plate 24 to be moved relative to core 22 prior to assembly therewith for defining blade receiving slot 42 to properly receive and locate cutting blade 38 relative to the cutting circle 40 of cutterhead assembly 8. In order to so properly align pressure plate 24 relative to core 22, these pieces are placed in a jig or fixing machine (not shown) with a standard cutting blade 38. The pressure plate 24 is thereafter moved relative to fixing bolts 26 and positioned on core 22 at a chosen location to locate the cutting edge 44 of cutting blade 38 with respect to cutting circle 40 of the cutterhead assembly 8 as shown in FIG. 5. Once this positioning of the pressure plate 24 is accomplished, pressure plate 24 can thereafter be permanently fixed relative to the core 22 by tightening the fixing bolts 26. It will be noted that the apertures 28 for receiving clamping bolts 30 are also laterally elongated to ensure the proper assembly of cover portion 32 with the subassembly of core 22 and pressure plate 24. Thus, it will be appreciated that the present invention allows pressure plate 24 and core 22 to be properly positioned relative to each other to accommodate a standard cutting blade 38 despite tolerance variations occurring during manufacture of the respective parts. Accordingly, these parts can be manufactured to less stringent tolerances, therefore resulting in an attendant reduction in the manufacturing cost of these parts.

The cutting blade 38 for the cutterhead assembly 8 can be installed thereon by longitudinally inserting it into blade receiving slot 42 from one end of the cutterhead assembly 8 in the manner shown in FIG. 8. To accomplish this installation, an operator simply loosens clamping bolts 30 on cover portion 32, inserts cutting blade 38 into slot 42, and thereafter moves it in a longitudinal direction along the cutterhead assembly 8 into the pre-operative position shown in FIG. 6. In this connection, attention is directed to FIG. 6, where the cutting blade 38 is shown as having a height slightly less than the height of blade receiving slot 42. For this reason, an air gap will exist within slot 42 between cutting blade 38 and the cantilevered portion of pressure plate 24 while clamping bolts 30 remain loose, enabling the cutting blade 38 to be easily and readily installed as described. Once cutting blade 38 has been so installed, clamping bolts 30 can be tightened to place the cutterhead assembly 8 in its operative condition. In this connection, the tightening of clamping bolts 30 will generate a clamping force which is directed by edge 36 of cover portion 32 against the cantilevered portion of pressure plate 24, as indicated by the arrow 52 in FIG. 7. Cover portion 32 will therefore clampingly load the cantilevered portion of pressure plate 24 biasing the cantilevered portion towards the core 22 for cooperation therewith to clampingly retain the cutting blade 38 within blade receiving slot 42.

Figure 6:
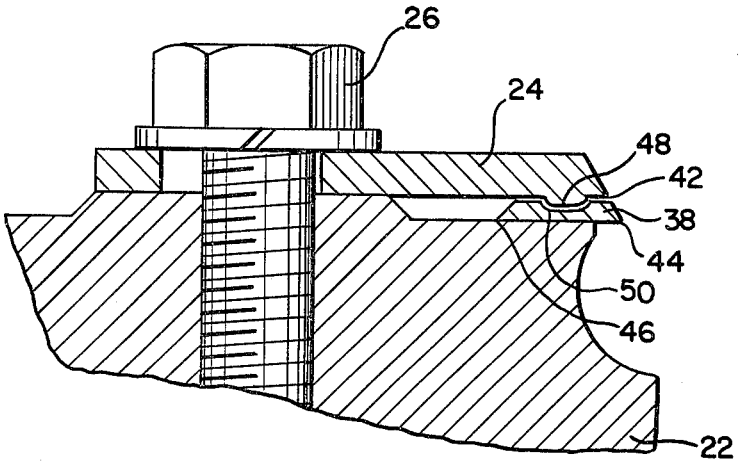
FIG. 6 is a fragmentary sectional view of a portion of the cutterhead assembly in a pre-operative position.
Figure 7:
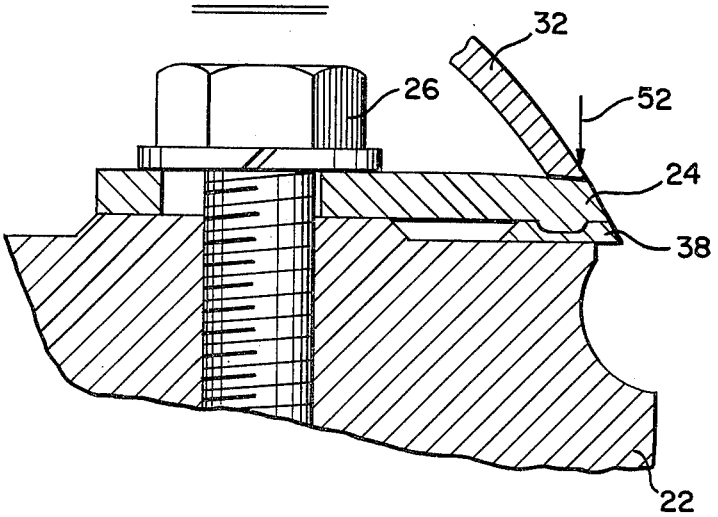
FIG. 7 is a fragmentary sectional view of a portion of the cutterhead assembly in its operative position.

With particular reference to FIG. 6, the cutting blade 38 includes a longitudinally extending recess or groove 50 along one face thereof. The cantilevered portion of pressure plate 24 includes a longitudinally extending projection 48 formed thereon and extending into blade receiving slot 42. This projection 48 is of a cross-sectional shape complementary with recess 50 and is of height sufficient to project into recess 50 when the cutting blade 38 is inserted into slot 42 prior to the tightening of clamping bolts 30. This feature ensures that the cutting blade 38 is not ejected by the action of centrifugal force during rotation of the cutterhead assembly. Rather, the projection 48 is operative to interferingly engage recess 50 to retain the cutting blade 38 within blade receiving slot 42 and prevent radial ejection of the cutting blade 38 therefrom if an operator neglects to tighten the clamping bolts 30 on the cover portion 32 prior to operation. In addition, the alignment and location of the pressure plate 24 relative to core 22 allows projection 48 to accurately locate a standard cutting blade 38 so that cutting edge 44 thereof is placed in its preferred position with respect to cutting circle 40 of the cutterhead assembly 8.

In order to utilize the power planer 2 incorporating the cutterhead assembly 8 of the invention, an operator simply loosens clamping bolts 30 and inserts a cutting blade 38 longitudinally into blade receiving slot 42 as described hereinabove. As previously noted, the cutterhead assembly 8 makes it unnecessary for the operator to undertake any adjustment of the cutting blade 38 or pressure plate 24 in order to properly locate the cutting edge 44 with respect to the cutting circle 40 of the cutterhead assembly 8. The operator can therefore place the cutterhead assembly 8 in an operative condition simply by tightening clamping bolts 30. When the cutting edge 44 of the cutting blade 38 becomes dull, the operator can reverse the cutting blade 38 by loosening the clamping bolts 30, withdrawing the cutting blade 38 and re-inserting it so that the opposite cutting edge 46 is exposed for cutting purposes. The clamping bolts 30 can thereafter be tightened to again place the assembly 8 in an operative condition. Replacement of cutting blades can be accomplished in a similar manner by simply loosening and tightening clamping bolts 30 for withdrawal and insertion of a new blade. Moreover, since fixing bolts 26 are not exposed when cover portion 32 is loosened inadvertent adjustment of the relative position between core 22 and pressure plate 24 is avoided. And, as previously noted, projection 48 on pressure plate 24 and recess 50 in the cutting blade 38 will be operative to prevent radial ejection of cutting blade 38 during operation of the power planer 2 if the operator forgets to tighten clamping bolts 30 during any of these operations.

Accordingly, it will be appreciated that the present invention provides a cutterhead assembly 8 which can receive cutting blades 38 of standard and predetermined dimensions without requiring the operator to make adjustments on the cutterhead assembly 8 in order to position the cutting blade 38 in proper elevation with respect to the cutting circle 40 of the cutterhead assembly 8. For this reason, the present invention provides a power planer device which can be utilized more conveniently and easily than prior known power planer devices. Furthermore, it is believed that the size and location of clamping bolts 30 provides a cutterhead assembly 8 which can be placed in an operative condition more easily and readily than prior known power planer devices having clamping bolts or screws of a size and location which require time consuming and tedious adjustments. Moreover, since projection 48 on pressure plate 24 is operative to interferingly engage recess 50 in cutting blade 38 in the unclamped condition, radial ejection of cutting blade 38 from the assembly 8 during operation of the power planer 2 is prevented. The assembly 8 therefore ensures that operator safety is maintained if the operator happens to neglect to tighten clamping bolts 30 before utilizing the device.

It will also be appreciated that the present invention provides a cutterhead assembly 8 of a simplified and less costly configuration. The elongated apertures 27 and 28 in pressure plate 24 enable the pressure plate 24 and core 22 to be manufactured to tolerances which are less severe than required by prior known power planer devices. The invention therefore provides a cutterhead assembly wherein the respective parts can be manufactured at a reduced cost. The core 22 can be made of extruded steel or aluminum, or in the alternative, of powdered metal. Pressure plate 24 is preferably made of steel and cover portion 32 from sheet metal. The cutting blades 38 used with the cutterhead assembly 8 can be made from high-grade tungsten steel, or less expensive carbon steel if desired.

What is claimed is:

1. A rotary cutterhead for a power planer, comprising:

an elongated core;

a pressure plate mounted on the core to define a cantilever portion of said pressure plate, said cantilever portion conjointly defining with said core a longitudinally extending slot-like opening for replaceably receiving a cutting blade;

positioning means for allowing positioning of said pressure plate relative to said core at a chosen location to enable the cutting edge of the cutting blade to project a predetermined amount beyond the cutting circle defined by said rotary cutterhead;

fixing means for fixing said pressure plate to said core at said chosen location without clamping said cutting blade in said slot-like opening whereby said cutting blade can be easily inserted in and withdrawn from said slot-like opening with said pressure plate so fixed in position; and clamping means, independent of said fixing means and operable between said core and said pressure plate, for clampingly loading said cantilever portion to bias the latter towards said core and tightly clamp said blade between said cantilever portion and said core.

2. A cutterhead as set forth in claim 1, further comprising blade retention means, operative independent of said clamping means, for preventing radial ejection of said cutting blade from said opening even if said clamping means have not been tightened to effect clamping of said blade.

3. A cutterhead as set forth in claim 1 further comprising a projection within said opening for engaging a recess in said cutting blade for locating said cutting blade in said opening and preventing radial ejection of said cutting blade from said opening.

4. A cutterhead as set forth in claim 1 wherein said fixing means comprises at least one threaded bolt assembled through said pressure plate and into a complementary threaded bore in said core for fixing said pressure plate at said chosen location.

5. A cutterhead as set forth in claim 4 wherein said positioning means includes an elongated through aperture in said pressure plate through which said bolt is inserted and which allows said pressure plate to be positioned relative to said bolt and said core and into said chosen location before said pressure plate is fixed at said chosen location by said fixing means.

6. A cutterhead as set forth in claim 1 wherein said clamping means can be loosened to permit longitudinal movement of said cutting blade relative to said opening for effecting replacement or reversal of said cutting blade without affecting said positioning means.

7. A rotary cutterhead for a power planer, comprising:

an elongated core;

a pressure plate mounted on the core to conjointly define therewith a longitudinally extending slot-like opening for receiving a cutting blade and locating a cutting edge of the cutting blade relative to the cutting circle defined by said rotary cutterhead;

positioning means for allowing positioning of said pressure plate relative to said core at a chosen location to enable the cutting edge of a standard cutting blade to project beyond said cutting circle a predetermined amount;

fixing means for fixing said pressure plate at said chosen location;

clamping means for tightly clamping said cutting blade between said core and said pressure plate; and said clamping means comprising a cover portion and a clamping bolt for assembling said cover portion with said core and said pressure plate, said cover portion including a clamping portion which engages said pressure plate adjacent said opening and which is operative to bias said pressure plate toward said core when said clamping bolt is tightened for clamping said cutting blade between said core and said pressure plate.

8. A cutterhead as set forth in claim 7 wherein said cover portion conceals said fixing means to prevent inadvertent adjustment of said positioning means.

9. A rotary cutterhead for a power planer which defines a cutting circle and which supports a cutting blade for rotation therewith, the cutterhead comprising:

an elongated central core;

a pressure plate mounted to said core by one or more threaded fixing bolts extending through a like number of elongated apertures in said pressure plate and into complementary threaded bores in said core, said pressure plate being movable relative to said fixing bolts and said core into a location wherein said pressure plate defines a cantilevered portion which cooperates with said core to define a longitudinally extending slot for receiving said cutting blade so that the cutting edge thereof projects beyond said cutting circle a predetermined amount;

a longitudinally extending projection on said cantilevered portion of said pressure plate which protrudes into said slot and engages a recess in said cutting blade for locating said cutting blade in said slot; and a cover portion configured to conceal said fixing bolts when assembled to said core by one or more clamping bolts extending through a like number of elongated apertures in said pressure plate and into complementary threaded bores in said core, said cover portion including a clamping portion which engages and biases said cantilevered portion of said pressure plate toward said core for cooperation therewith to clampingly retain said cutting blade within said slot when said clamping bolts are tightened.

10. A method of assembling a rotary cutterhead for a power planer which supports a standard cutting blade of predetermined dimensions so that the cutting edge of any such cutting blade when installed on said cutterhead will extend beyond the cutting circle of the cutterhead a predetermined optimum distance for performing a cutting operation on a workpiece, comprising the steps of:

loosely mounting a pressure plate on a core to define a slot-like opening between said core and a cantilever portion of said pressure plate for receiving a standard cutting blade and locating the cutting edge thereof relative to said cutting circle;

installing a standard cutting blade within said slot-like opening with an air gap within said slot-like opening between the cutting blade and said cantilever portion;

positioning said pressure plate relative to said core at a chosen location so that the cutting edge of said cutting blade extends beyond said cutting circle said optimum distance;

fixing said pressure plate to said core at said chosen location with said air gap still existing between the cutting blade and said cantilever portion;

assembling a cover portion over said fixed pressure plate; and clamping said cover portion to said core to clampingly load said cantilever portion and bias the latter towards said core to close said air gap and tightly clamp the blade in said slot-like opening.

11. The method as set forth in claim 10 wherein the cutting blade is replaced by loosening the clamping of said cover portion only, withdrawing the cutting blade from said slot-like opening, inserting another standard cutting blade into said slot-like opening, and re-clamping said cover portion.

12. A cutterhead assembly for a power planer, comprising:

an elongated core having at least one threaded bore therein;

a pressure plate fixed to said core by at least one bolt extending through an aperture in said pressure plate and into said bore;

said pressure plate including a cantilevered portion which cooperates with a face of said core to define a longitudinally extending slot for receiving a cutting blade;

said aperture being laterally elongated to allow said pressure plate to be moved relative to said core for properly defining said slot prior to said pressure plate being fixed to said core by the tightening of said bolt;

said blade being readily installed and removed by longitudinal insertion into and withdrawal from said slot from one end of said assembly with said pressure plate so fixed;

a cover portion assembled over said pressure plate with at least one clamping bolt extending through said cover portion and said pressure plate into said core; and whereby when said clamping bolt is tightened, said cover portion clampingly loads said cantilevered portion causing the latter to cooperate with said core to clampingly retain said blade in said slot.

* * * * *